US010099488B2

(12) United States Patent
Klages et al.

(10) Patent No.: US 10,099,488 B2
(45) Date of Patent: Oct. 16, 2018

(54) MARKING DEVICE

(71) Applicant: PHOENIX CONTACT GMBH & CO. KG, Blomberg (DE)

(72) Inventors: Kilian Klages, Detmold (DE); Moez Bibani, Detmold (DE); Jörg Donoth, Paderborn (DE); Mario Hiss, Willstätt (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 7 days.

(21) Appl. No.: 15/129,103

(22) PCT Filed: Mar. 25, 2015

(86) PCT No.: PCT/EP2015/056363
§ 371 (c)(1),
(2) Date: Sep. 26, 2016

(87) PCT Pub. No.: WO2015/144749
PCT Pub. Date: Oct. 1, 2015

(65) Prior Publication Data

US 2017/0106672 A1 Apr. 20, 2017

(30) Foreign Application Priority Data

Mar. 26, 2014 (DE) ..... 10 2014 004 365

(51) Int. Cl.
*B41J 13/00* (2006.01)
*B41J 11/06* (2006.01)
(Continued)

(52) U.S. Cl.
CPC ..... *B41J 11/06* (2013.01); *B41J 2/442* (2013.01); *B41J 3/407* (2013.01)

(58) Field of Classification Search
CPC . B41J 11/06; B41J 2/442; B41J 3/407; B41M 5/24; B41M 5/26
See application file for complete search history.

(56) References Cited

U.S. PATENT DOCUMENTS 6,135,316 A * 10/2000 Wolfer ..... G11B 23/00 221/299
6,760,052 B2 7/2004 Cummins et al.
(Continued)

*Primary Examiner* — Julian Huffman
*Assistant Examiner* — Michael Konczal
(74) *Attorney, Agent, or Firm* — David S. Safran; Roberts Mlotkowski Safran Cole & Calderon, P.C.

(57) ABSTRACT

Marking device for marking information carriers, has a housing, a marking unit, a marking region inside the housing, and a holding device for holding at least one information carrier. The holding device is movable between a loading and unloading position outside the marking region and a marking position inside the marking region. A feed magazine for a plurality of information carriers to be marked, a deposit magazine for depositing a plurality of marked information carriers, a conveyor device and a positioning device are provided. An information carrier can go from the feed magazine into a first lower level below the holding device in the marking region by means of the conveyor device and vertically between the first lower level and the marking position in a second upper level by the positioning device, and from the first lower level in the marking region to the deposit magazine by the conveyor device.

11 Claims, 9 Drawing Sheets

(51) Int. Cl.
*B41J 2/44* (2006.01)
*B41J 3/407* (2006.01)

(56) References Cited

U.S. PATENT DOCUMENTS

| | | | | |
|---|---|---|---|---|
| 6,939,001 | B2 | 9/2005 | Buibas | |
| 7,063,746 | B2 | 6/2006 | Russ | |
| 8,941,705 | B2 | 1/2015 | Bier et al. | |
| 2003/0222926 | A1* | 12/2003 | Cummins | B41J 3/4071 347/2 |
| 2004/0213914 | A1* | 10/2004 | Russ | B41J 11/007 427/421.1 |
| 2007/0264073 | A1* | 11/2007 | Hanada | B41J 3/4071 400/521 |
| 2008/0256565 | A1* | 10/2008 | Kubin | B41J 3/4071 720/619 |
| 2008/0271064 | A1* | 10/2008 | Kubin | B41J 3/36 720/672 |

* cited by examiner

MARKING DEVICE

BACKGROUND OF THE INVENTION

Field of the Invention

The invention relates to a marking device for marking information media, with a housing, with a marking unit, with a marking region made inside the housing, and with a receiving device for receiving at least one information medium, whereby the receiving device can be moved between a loading and unloading position outside of the marking region and a marking position inside the marking region.

Description of Related Art

In industrial and commercial practice, different types of identifying and marking signs for identifying and labeling machines, devices, clamps or cables, to which information relative to the components to which they are assigned is applied, are used. To this end, the identifying or marking signs are usually provided in a marking device with a corresponding marking pattern, in general alphanumeric characters. In this case, the marking can be done in particular by means of a printer, for example an inkjet printer, a thermal transfer printer, or a UV printer, with which the information is imprinted on the respective identifying or marking sign. Such marking printers are known from, for example, the catalog "Markierungssysteme Werkzeuge Montagematerial [Marking Systems Tools Assembly Material], 2011 CLIPLINE 2," pages 26 to 29 of the Phoenix Contact GmbH & Co. KG.

Moreover, marking devices that have a marking laser as a marking unit, which laser directly exposes the surface of the identifying or marking sign to be marked to a laser beam, so that the marking is not done by printing but rather by treating the material of the identifying or marking sign, have been used for several years. Depending on the material of the identifying or marking sign and depending on the wavelength of the laser, in this case the marking can be done by staining carbonization, foaming, engraving, or material removal. The marking device according to the invention preferably has such a marking laser as a marking unit, without, however, the invention being limited thereto.

For marking the individual identifying or marking signs, the latter can be inserted individually into a corresponding receptacle in the marking region of the marking device. This has the advantage that relative to the size of the identifying signs, a very great flexibility exists. In this connection, however, the relatively large amount of time required for the exact positioning of the identifying or marking sign within the marking region is disadvantageous, so that marking devices, in the case of which the identifying or marking signs have to be inserted individually into a receptacle, are suitable only for marking small numbers of units.

In addition to individual, in most cases larger, identifying or marking signs, so-called marking units or cards that have multiple individual identifying signs, which are attached via arms in an outer frame, are in practice often used. After the marking, the individual identifying signs, which are often used for conductor and cable marking or for clamp marking, can be separated from the frame of the marking unit. Moreover, multiple identifying or marking signs can also be applied, in particular glued, on a common carrier sheet, from which the individual identifying or marking signs can be easily peeled off after the marking. In practice, such carrier sheets are often also referred to as labeling sheets or sheet-stock. Below, the different types of identifying and marking signs in general are referred to as information media, whereby in this case, this can involve both individual identifying or marking signs and marking units or carrier sheets with multiple identifying or marking signs.

An above-described marking device for marking identifying signs with a marking laser as a marking unit is known from, for example, German Patent Application DE 10 2010 051 539 A1 and corresponding U.S. Pat. No. 8,941,705 B2. The marking device has a housing that consists of a housing base and a hood as well as a rotary table provided with a support surface for the identifying signs. In this case, the rotary table is between a labeling position, in which the support surface is completely covered by the hood, and a loading position, in which the support surface is movably located outside of the hood. To prevent laser light from penetrating the housing, sealing ridges are provided that are to seal the gap between the housing base and the hood. As a result, the marking laser can be operated without a user having to wear protective goggles.

If a larger number of information media are to be marked with the known marking device, this is relatively time-consuming, since the individual information media must always be placed manually on the support surface of the rotary table. Moreover, only marking units whose dimensions are matched to the preset dimensions of a recess made in the rotary table can be marked with the known marking device.

SUMMARY OF THE INVENTION

The object of this invention is therefore to provide a marking device with which the different information media can be marked as easily and quickly as possible.

This object is achieved in the case of the above-described marking device as described herein, in such a way that the marking device, in addition to the receiving device, still has a feed magazine for receiving multiple information media that are to be marked, a deposit magazine for depositing multiple marked information media, a conveyor device, and a positioning device. In this case, an information medium that is to be marked can be taken by means of the conveyor device from the feed magazine into a first, lower level in the marking region, whereby this first level is arranged below the receiving device. In addition, the information medium can be moved vertically by means of the positioning device between the first, lower level in the marking region and its marking position into a second, upper level in the marking region, so that the information medium can be marked by the marking unit. Finally, using the conveyor device, the information medium can be taken from the first, lower level in the marking region to the deposit magazine.

With the marking device according to the invention, an information medium that is to be marked can be marked in such a way that the information medium is inserted into the receiving device provided above, which device is then moved into its marking position inside the marking region. After the marking, the receiving device pulls out again from the marking region, so that the information medium can be removed from the receiving device by a user. Moreover, the marking device according to the invention also makes possible an automatic marking of multiple information media, which are moved in succession from the feed magazine into the marking region using the conveyor and positioning device provided in the marking device, marked there by the marking unit, and then laid down in the deposit magazine with the transport device.

The selective marking of individual information media in manual operation or in automatic operation is, in this case, possible in such a way that an information medium that is to be marked is moved into the marking position in the marking region depending on the type of operation—manual or automatic—in various ways and by various means. In manual operation, an information medium is inserted by the user into the receiving device provided above, which device, in this respect, can be moved from a loading and unloading position outside of the marking region horizontally into a marking position inside the marking region. In automatic operation, individual information media are moved in succession first by means of the conveyor device from the feed magazine into a first, lower level in the marking region, and then raised with the positioning device vertically in a second, upper level in the marking region, marked there, and then again lowered into the lower level, and finally conveyed by means of the positioning device into the deposit magazine.

According to an advantageous configuration of the invention, the receiving device has a frame and a replaceable insert that is inserted into the frame. In this connection, a simple matching of the receiving device to the respective type of operation and to various types of information media is possible in a simple way, by having a correspondingly designed insert simply be inserted into the frame that is mounted to move in the housing. If the marking device has a marking laser as a marking unit, it is ensured by the selection of the corresponding insert that the top of the information medium is located in the focal plane of the laser beam of the marking laser if the information medium is located in the marking position.

In this case, for automatic operation, it is advantageously provided that the insert has a recess that is designed in such a way that an information medium that is secured to the insert from below in its marking position can be marked through the recess. In this connection, it is first ensured that the receiving device in the automatic operation of the marking device can remain in its marking position inside the marking region, so that the receiving device does not have to be either disassembled or permanently moved into the loading and unloading position outside of the marking region or the housing. As a result, it is possible to avoid both modifications and risks that a receiving device projecting from the housing during the marking process of multiple information media may be damaged.

In automatic operation, the receiving device is used rather as a positioning aid and stop for an information medium that is to be marked, which medium, using the positioning device, is raised from the first, lower level in the marking region into its marking position in the second, upper level in the marking region. As a result of an information medium that is to be marked being pressed by the positioning device from below against the insert of the receiving device, an exact positioning of the information medium in its marking position can be ensured in a simple way.

For manual operation, the receiving device has an insert with a support surface, on which an information medium can be positioned. Also, in this connection, a simple and exact positioning of an information medium is ensured, whereby by using different inserts with differently dimensioned support surfaces, the possibility is provided of inserting different information media into the receiving device and thus of marking with the marking unit. By a corresponding sizing of the insert, in particular its thickness or the depth of the support surface, it is also ensured in this case that the surface of the respective information medium is at the correct distance from the marking unit, i.e., the top of the information medium is located in the focal plane of the laser beam in the case of a marking laser as a marking unit.

Relating to the actual configuration of the conveyor device and the positioning device, there are various possibilities, in principle. As has already been explained above, the conveyor device is used to convey an information medium first from the feed magazine into the first, lower level in the marking region and then—after the information medium has been marked—from the first level in the marking region to the deposit magazine. While the task of the conveyor device is thus to convey an information medium on a generally horizontal path from the feed magazine in two steps to the deposit magazine, that of the positioning device is to raise the information medium from the first, lower level in the marking region into the second, upper level in the marking region, in which the information medium is located in its marking position, so that it can be marked by the marking unit. After the marking is done, the information medium is then lowered by the positioning device back into the first, lower level in the marking region, so that the marked information medium can be conveyed by the conveyor device to the deposit magazine.

According to an advantageous configuration of the invention, the conveyor device has two conveyor belts that run parallel to one another and on which an information medium rests when the latter is conveyed from the feed magazine into the marking region and from the marking region into the deposit magazine. The two conveyor belts in this case are at a distance from one another, which distance is somewhat smaller than the corresponding dimensions of the information medium that is to be conveyed, i.e., than its extension perpendicular to the conveying direction. Such a configuration of the conveyor device with two conveyor belts, which can be moved via motor-driven drive rollers and output rollers, makes it possible, in an especially simple way, both to receive an information medium from the feed magazine designed as a destacking magazine and to deposit the information medium in the deposit magazine designed as a stacking magazine.

Moreover, when using two conveyor belts, an information medium can also be easily raised by a correspondingly designed positioning device from the first, lower level in the marking region into the second, upper level in the marking region. To this end, the positioning device preferably has a lifting plate, which can be moved between a first, lower position and a second, upper position. In the first, lower position, the lifting plate is located below an information medium that rests on the conveyor belt and is conveyed into the first level in the marking region. By raising the lifting plate into its second, upper position, the information medium is easily withdrawn from the conveyor belt and raised with the lifting plate, so that the information medium can be moved into its marking position in the second, upper level in the marking region. After the marking process is completed, the information medium is easily laid back down onto the conveyor belt in such a way that the lifting plate moves back from its second, upper position into its first, lower position. The raising and lowering of the lifting plate can be done, for example, by means of an electric motor and a gear rack or an eccentric.

Thus, when the lifting plate is raised, the latter is not obstructed by the conveyor belts; the corresponding dimension width of the lifting plate according to an embodiment is smaller than the distance between the two conveyor belts. The lifting plate can thus be raised between the two conveyor belts. This then necessarily means that the width of the lifting plate, i.e., its extension perpendicular to the conveying direction of the conveyor belts, is also smaller than the corresponding dimension of the information medium that is attached to the conveyor belt.

In an alternative configuration, the maximum width of the lifting plate is greater than the distance between the two conveyor belts. Thus, even in this case, the lifting plate can be raised without being obstructed by the conveyor belts; the conveyor belts are guided in a meandering manner in the area of the marking region by multiple conveyor rollers, which are arranged in two different levels. The areas of the lifting plate, which have a width that is greater than the distance of the two conveyor belts, are then also located in the first position of the lifting plate between two adjacent upper conveyor rollers and thus above the assigned section of the conveyor belts.

To ensure especially secure receiving of an information medium when it is being raised from the first, lower position in the marking region into the second, upper position in the marking region, the lifting plate preferably has upward-projecting positioning stops, between which stops an information medium can be positioned. The distance between two positioning stops that are opposite to one another is selected in this case in such a way that it corresponds to the corresponding dimensions of the information medium, so that the information medium is held between the positioning stops that are opposite to one another.

If the positioning stops are located on the front sides of the lifting plate running perpendicular to the conveying direction, the width of the lifting plate as a whole can be selected smaller than the distance between the two conveyor belts. If the positioning stops, however, are arranged on the longitudinal sides of the lifting plate running parallel to the conveying direction, the conveyor belts—as described above—are guided in a meandering manner in the area of the marking region. The positioning stops are then located in the first position of the lifting plate between two adjacent upper conveying rollers and thus above the assigned section of the conveyor belts.

The marking process of individual information media can be further simplified for a user according to an advantageous configuration of the marking device for a user in such a way that the insert of the receiving device has on its top an identifying field in which information is applied on the information medium that is to be marked. The information that is applied in the identifying field is, in this case, such information that is required by the marking device for marking the information medium. In this connection, this can be, in particular, the indication of the material of the information medium that is applied as an article number, for example in the form of a barcode, in the identifying field. Such a barcode, applied to the insert at a preset position, can be read-in before the marking process by the marking device; to do this, the latter has an optical acquisition element, for example a barcode laser, arranged inside the marking region. If the marking unit of the marking device is, for example, a marking laser, the optimal radiation intensity and the irradiation time are automatically set based on the acquired information and the material of the information medium that can be determined therefrom. Manual setting or input of these marking parameters can thus be omitted.

According to another advantageous configuration, moreover, an identifying field is also provided on individual information media, in particular on individual marking units in the edge area. In this identifying field, the information can be applied by the marking unit of the marking device according to the marking process, which areas of the information medium or which individual identifying signs of the marking unit have been marked and which areas or identifying signs are not yet marked. Also, in this connection, the information can be applied, for example, in the form of a barcode in the identifying field. If the marking unit is a marking laser, the information can be applied by the laser, which is also used for marking the information medium.

In the case of marking units with multiple identifying signs, in practice, it often occurs that initially only a part of the individual identifying signs is marked, while the remaining identifying signs are only marked at a later time. As a result, according to the above-described preferred configuration of the marking device according to the invention, of the information being applied on the information medium after a marking process, which individual identifying signs are already marked, mismarking of the information medium, which otherwise could no longer be used under certain circumstances, can be avoided.

In particular, there are now a large number of possibilities of configuring and further developing the marking device according to the invention as will be apparent from the following description of a preferred embodiment in connection with the accompanying drawings.

DETAILED DESCRIPTION OF THE INVENTION

Figure 1:
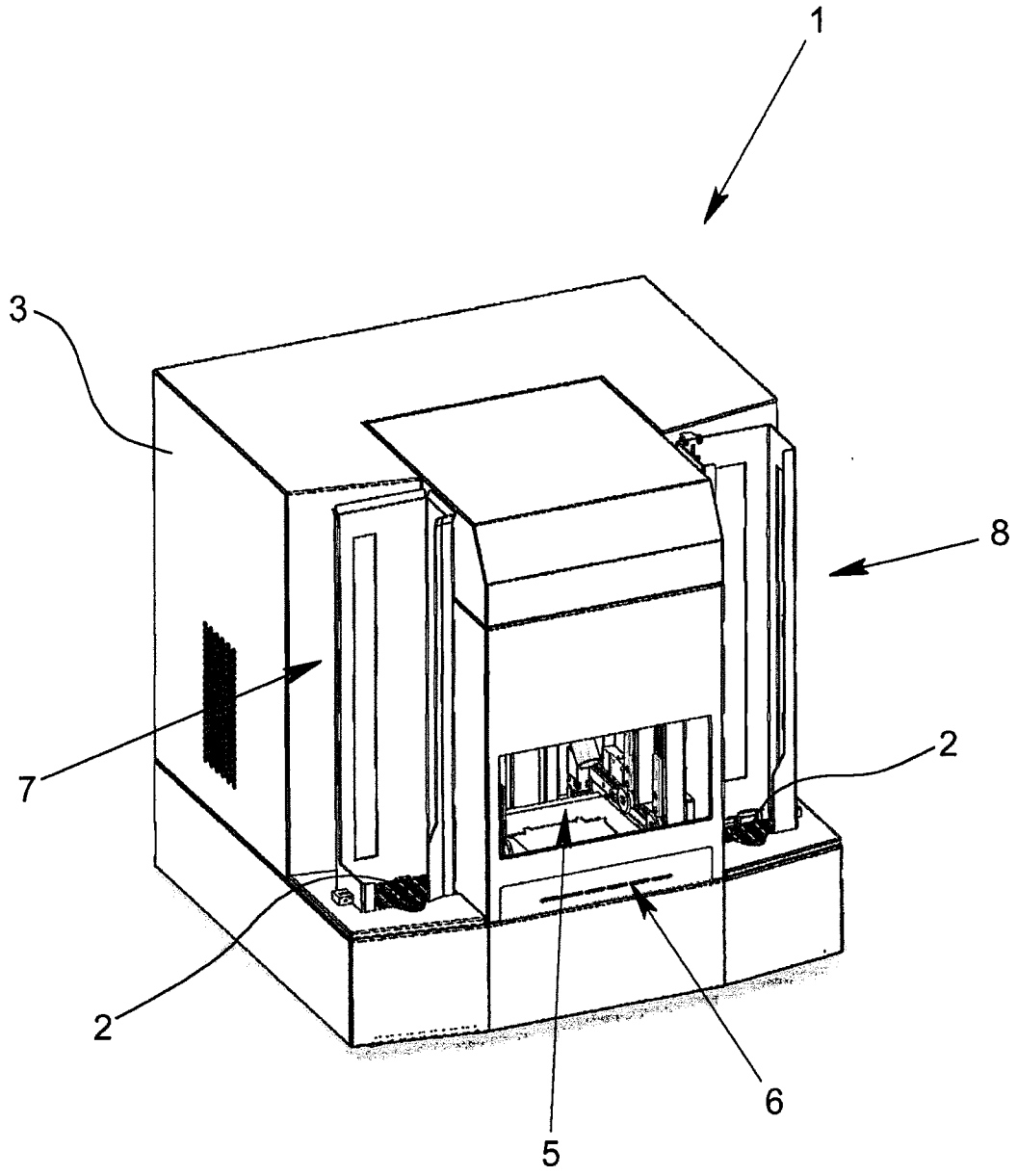
FIG. 1 is a perspective view of a preferred embodiment of a marking device.
Figure 2:
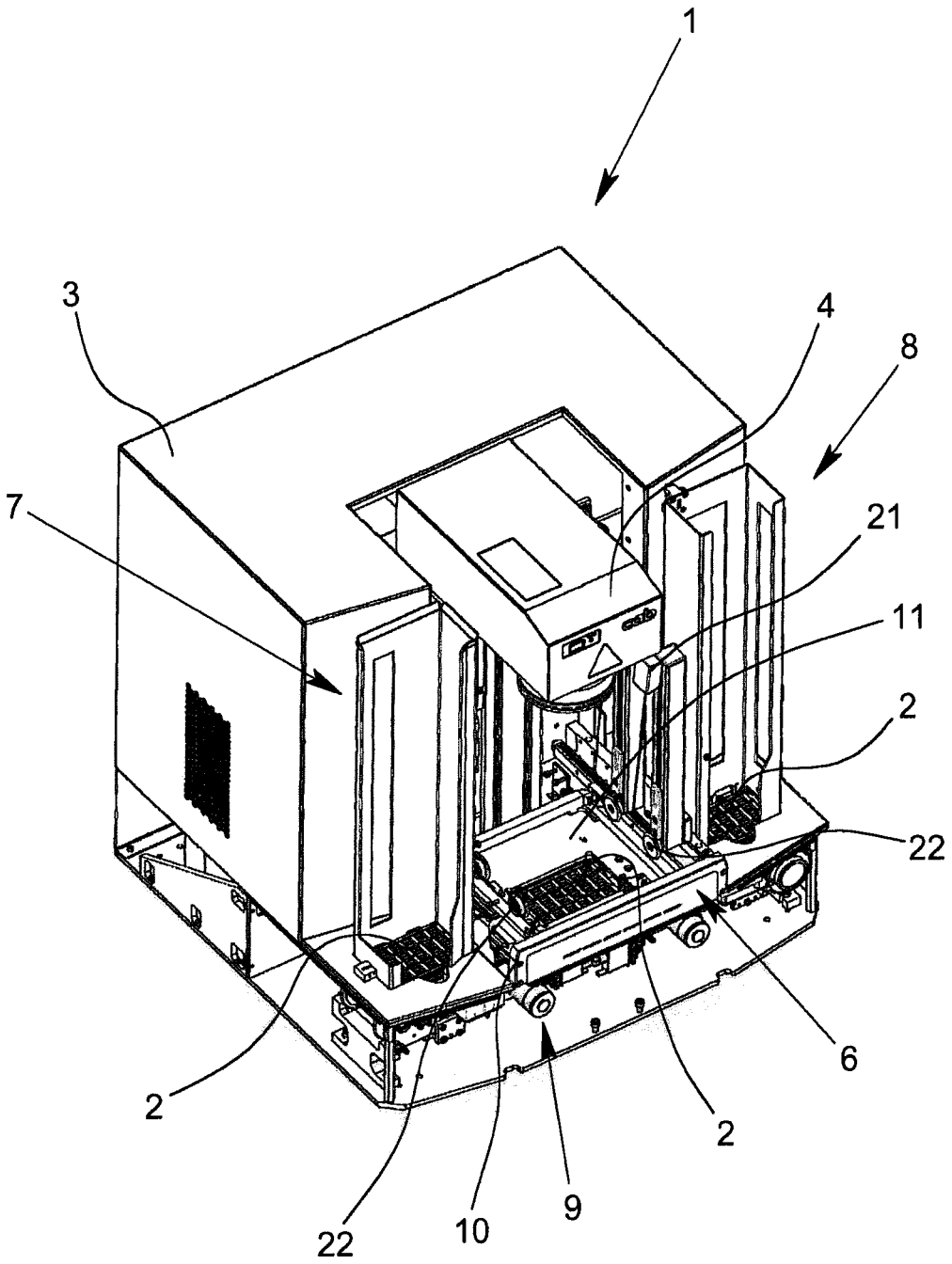
FIG. 2 shows the marking device according to FIG. 1 with a partially omitted housing.
Figure 3A:
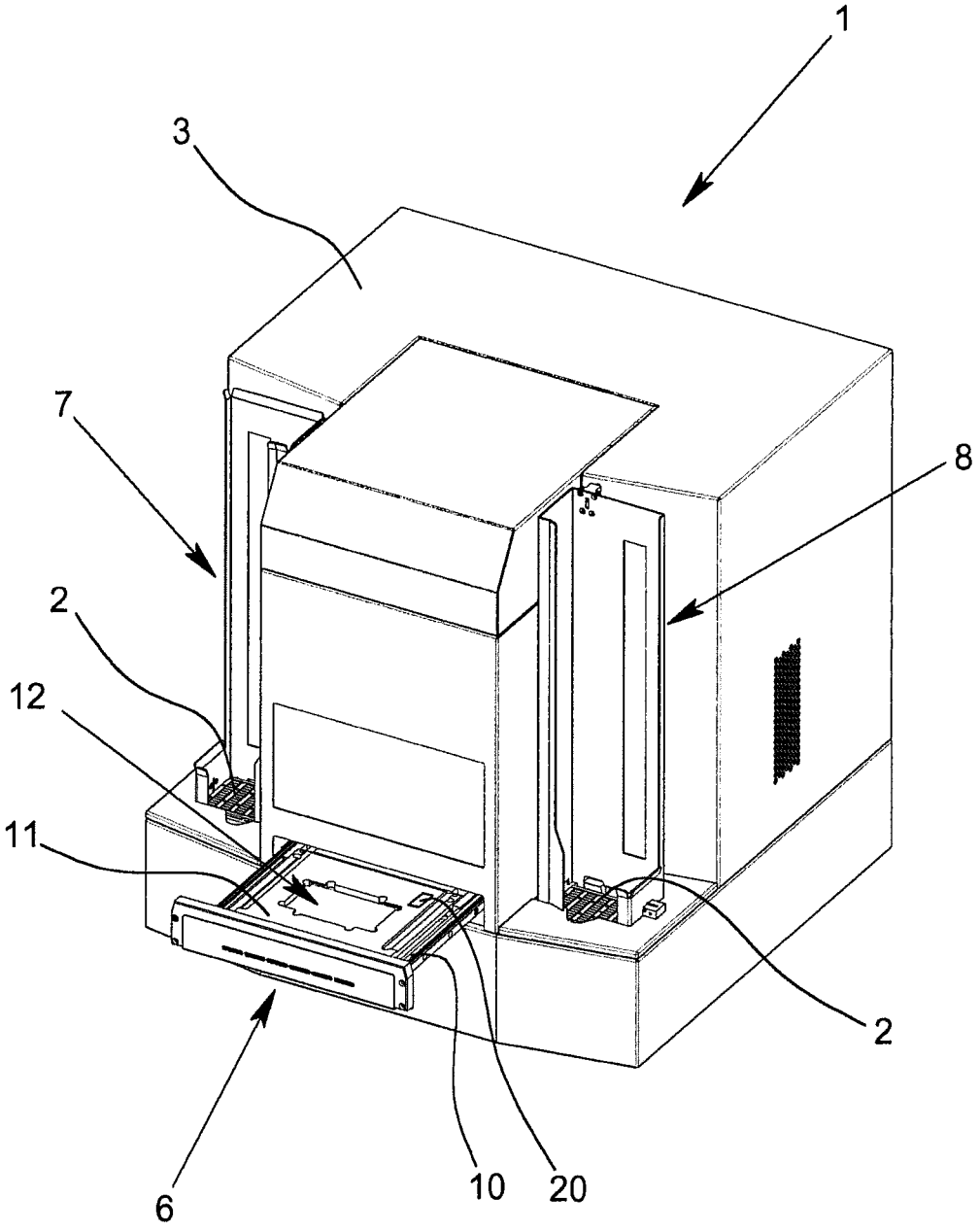
FIGS. 3*a*-3*c* show three marking devices, in each case with a receiving device in the loading and unloading position.
Figure 3B:
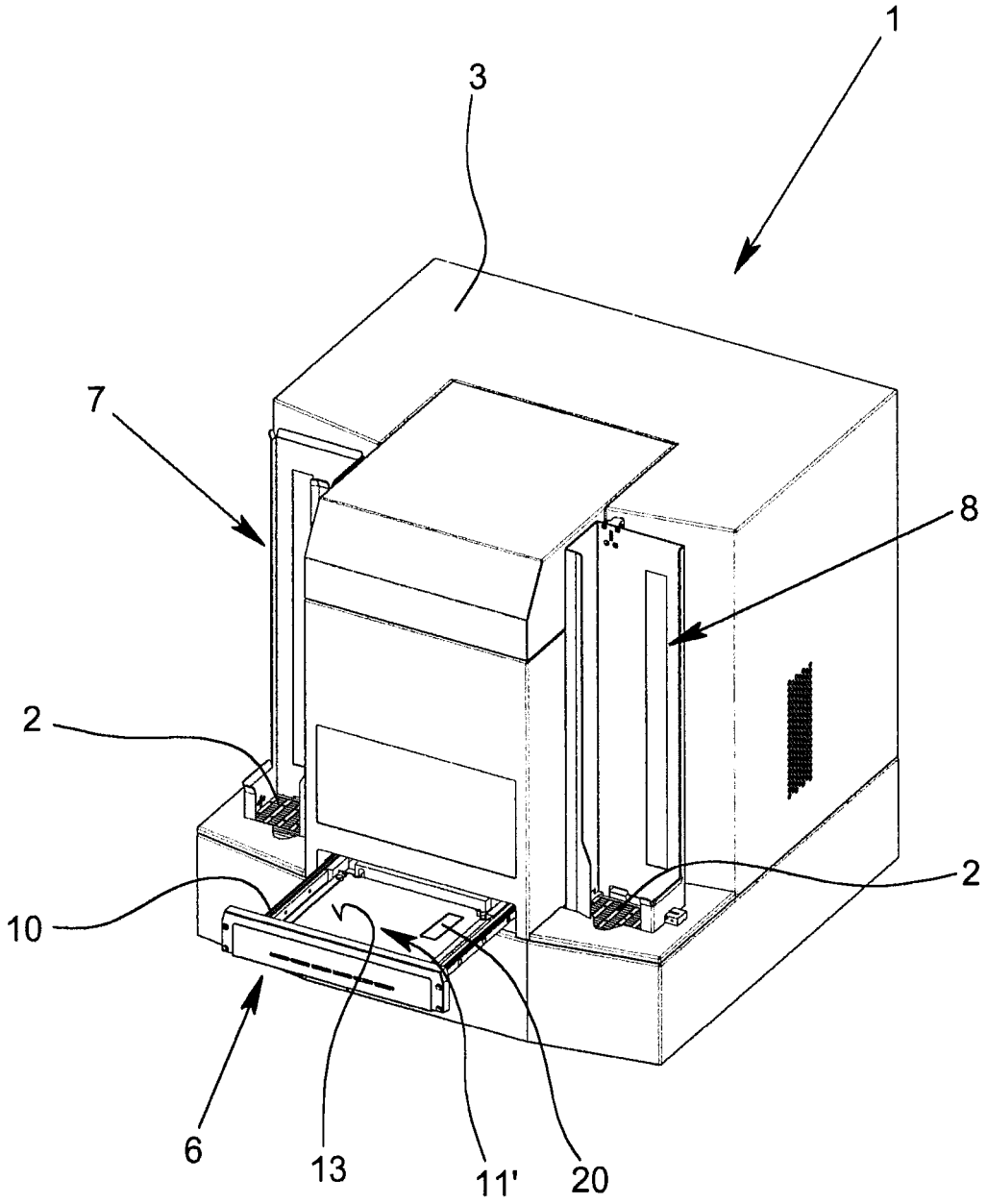
Figure 3C:
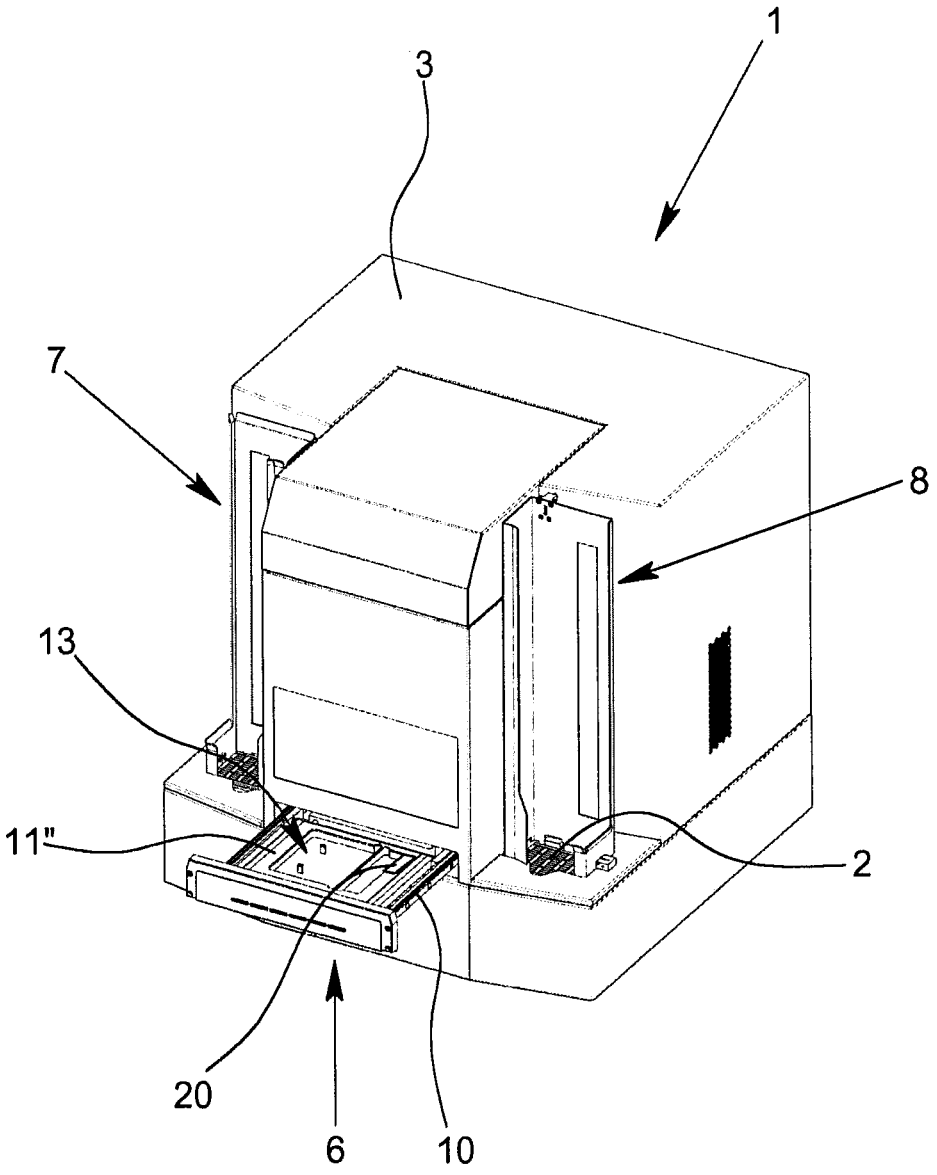

FIGS. 1, 2 and 3*a*-3*c* show a marking device 1 for marking different information media 2, which device has a multi-part housing 3, in which a marking unit 4 is arranged and a marking region 5 is designed. The depicted marking device 1 has a marking laser as a marking unit 4, which is arranged above the marking region 5, so that the surface of an information medium 2 that is to be marked can be exposed directly to a laser beam for marking when the information medium 2 is located in its marking position, in which the surface of the information medium 2 is arranged in the focal plane of the laser beam. In this case, depending on the material of the information medium 2, the marking is done by staining carbonization, foaming, engraving, or material removal of the surface of the information medium 2. In addition, the marking device 1 has a receiving device 6 for receiving an information medium 2, which can be moved like a type of sliding drawer between a loading and unloading position outside of the marking region 5 as shown in FIGS. 3*a*-3*c* and a marking position inside the marking region 5 as shown in FIGS. 1 and 2.

In addition to the receiving device 6, with which an information medium 2 can be introduced into the marking region 5 in the manual operation of the marking device 1, the marking device 1 has a feed magazine 7 for receiving multiple information media 2 that are to be marked and a deposit magazine 8 for depositing multiple marked information media 2. As FIGS. 1,2 and 3*a*-3*c* show, the feed magazine 7 and the deposit magazine 8 are in each case located laterally beside the marking region 5 that is closed by the housing 3, whereby in both magazines, up to 50 marking units can be accommodated. In order to convey the individual information media 2 arranged in the feed magazine 7 into the marking region 5 in the automatic operation of the marking device 1, a conveyor device 9 and a positioning device are provided in the lower area of the housing 3 of the marking device 1, which are described more precisely below in connection with FIGS. 4 to 6.

From FIGS. 3*a*-3*c*, it can be seen that the receiving device 6 has a frame 10 that is mounted to move in the housing 3 and in which different inserts 11, 11', 11" can be positioned. By inserting a corresponding insert, in this case a simple matching of the receiving device 6 to the respective type of operation—manual or automatic—of the marking device 1 as well as to different types of information media 2 is possible.

The insert 11 depicted in FIG. 3*a* is, in this case, provided for the automatic operation of the marking device 1. The insert 11 has a recess 12, which is matched with its dimensions to the dimensions of the information medium 2 arranged in the feed magazine 7 in such a way that an information medium 2 that is secured from below to the insert 11 in its marking position can be marked with the laser beam through the recess 12. Also, in automatic operation, the receiving device 6 thus is not located in the loading and unloading position depicted in FIG. 3*a* outside of the marking region 5, but rather the receiving device 6 is run into the housing 3, as is depicted in FIGS. 1 and 2, so that the insert 11 is located inside the marking region 5. The receiving device 6 or the insert 11 inserted into the frame 10 is used in automatic operation thus as a positioning aid and stop for an information medium 2 that is to be marked, which to this end is secured in its marking position from below on the insert 11.

FIGS. 3*b* and 3*c* show the marking device 1 according to the invention with two different inserts 11' and 11" for manual operation, which in each case has a support surface 13 for a corresponding information medium 2. The insert 11' according to FIG. 3*b*, in this case, is used for inserting an information medium 2 in the form of a carrier sheet, to which individual identifying or marking signs are glued, whereby the dimensions of the carrier sheet essentially correspond to the dimensions of the insert 11' of the receiving device 6.

The insert 11" according to FIG. 3*c* is used for receiving an information medium 2 that is designed as a marking unit and that can have similar or identical dimensions to the information medium 2 laid down in the feed magazine 7. By inserting another insert 11" with a support surface 13, which has other dimensions, information media 2 with different dimensions can thus be inserted in a simple way into the receiving device 6 and can be marked in manual operation by the marking device 1. As a result of the individual inserts 11, 11', 11" being able to be easily inserted into the frame 10 of the receiving device 6, a transition between automatic operation and manual operation of the marking device 1 as well as a "modification" in the case of different information media 2 in manual operation is quickly and easily possible.

Figure 4:
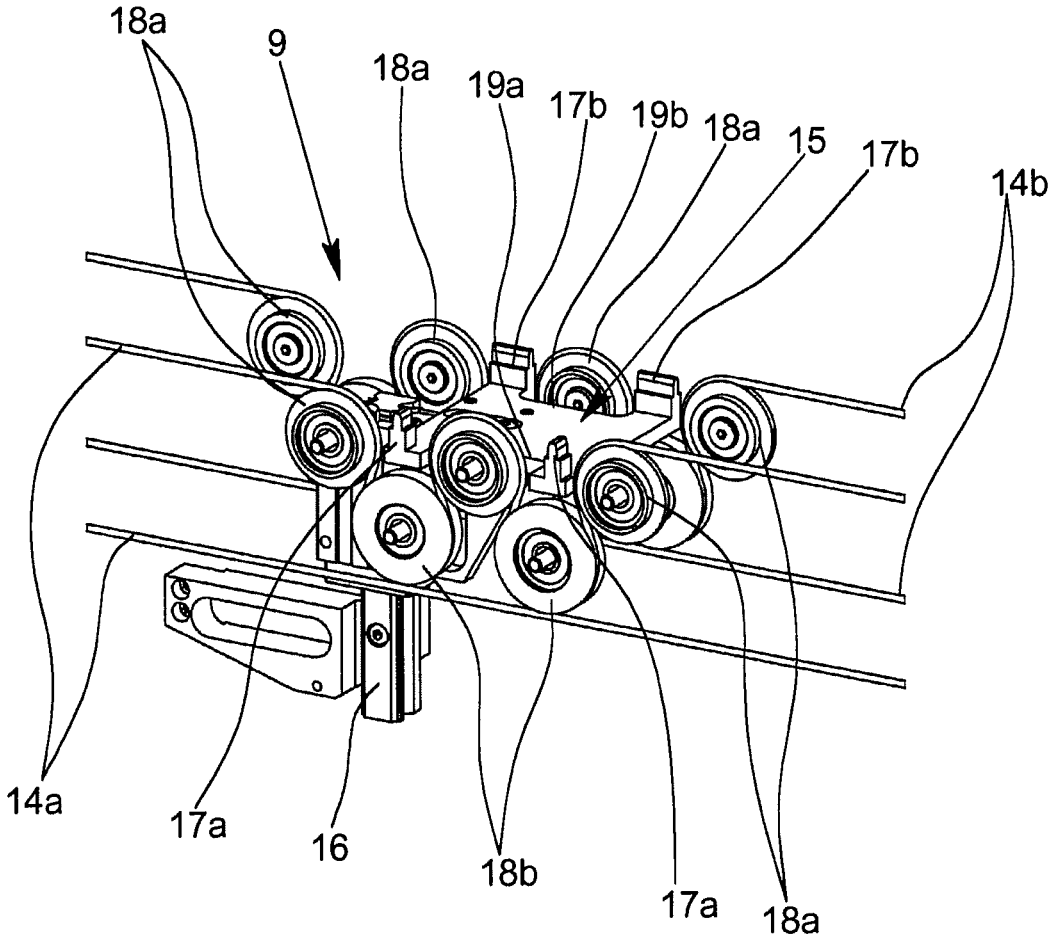
FIG. 4 is an enlarged view of the conveyor device and the positioning device.
Figure 5:
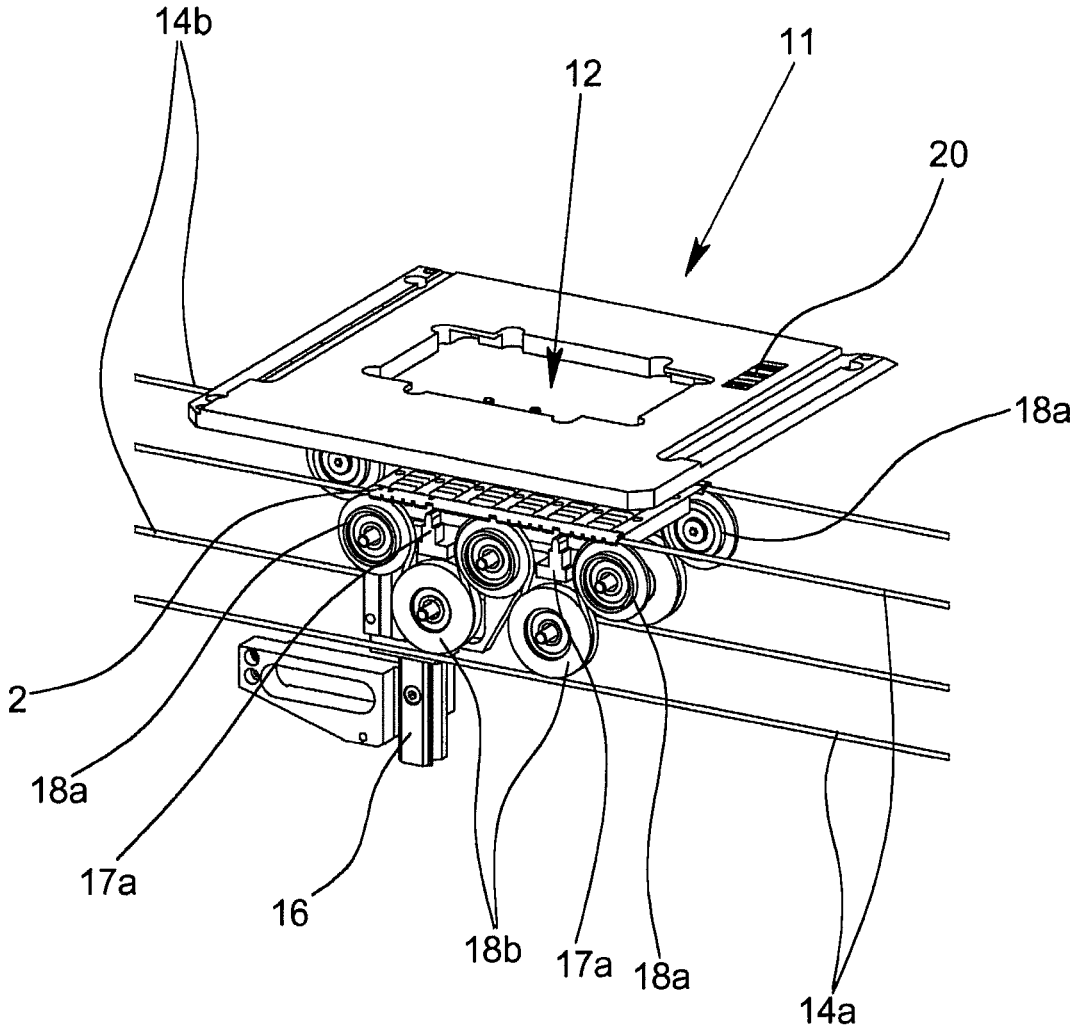
FIG. 5 is an enlarged view of the conveyor device and the positioning device according to FIG. 4, with an insert of a receiving device and an information medium in the first, lower position.
Figure 6:
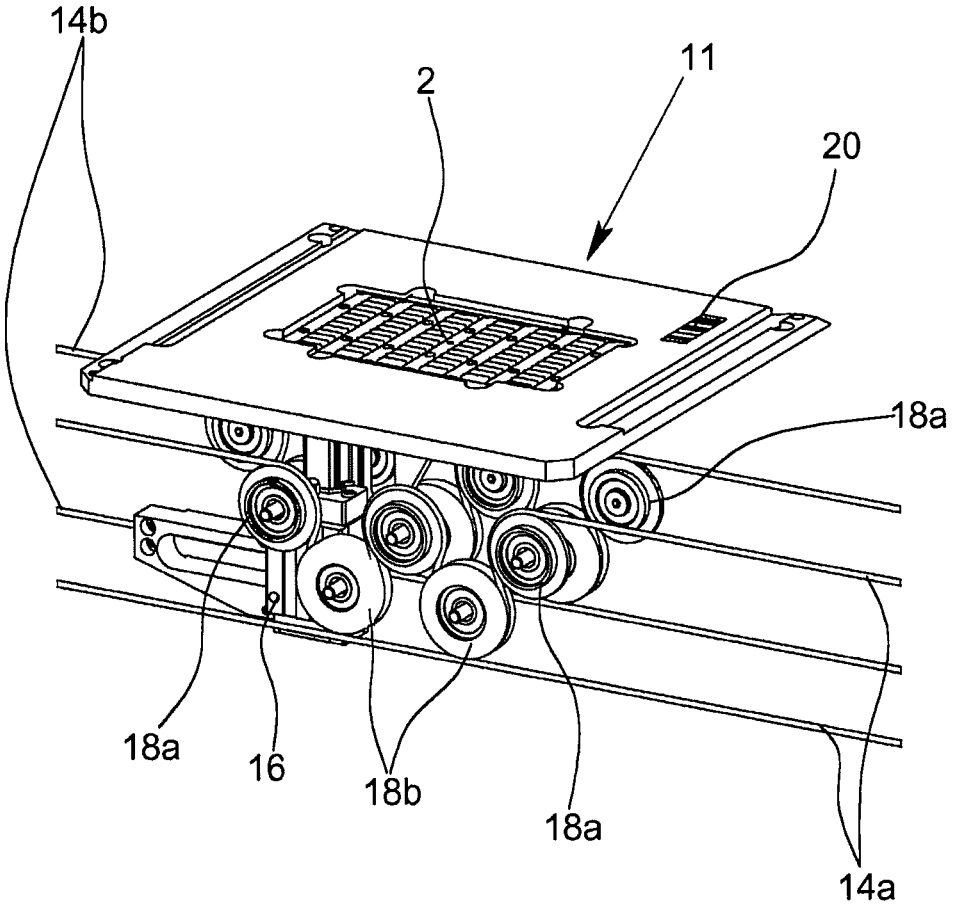
FIG. 6 shows the conveyor device and the positioning device according to FIG. 5, with an information medium in the second, upper position.

FIGS. 4 to 6 show an enlarged cross-section of the conveyor device 9, which has two conveyor belts 14*a*, 14*b* that run parallel to one another. The conveyor device 9, moreover, also includes a drive motor as well as drive and output rollers, which are not depicted here since their configuration is known to one skilled in the art, and the corresponding concrete configuration of the conveyor device 9 for this invention is not essential. Moreover, the lifting plate 15 of the positioning device, which can be moved between a first, lower position (FIGS. 4 and 5) and a second, upper position (FIG. 6) is depicted. To this end, the lifting plate 15 is fastened to a rod 16, which can be run vertically by means of a motor, also not depicted. For conversion of the rotational movement of the motor into the translational movement of the rod, for example, an eccentric that is arranged on a shaft can be provided, for example.

In order to ensure an especially secure receiving of an information medium 2 during the raising from the first, lower position in the marking region 5 into the second, upper position, the lifting plate 15 has four positioning stops 17*a*, 17*b* that are opposite to one another in pairs. The distance between two positioning stops 17*a*, 17*b* that are opposite to one another is, in this case, selected in such a way that it corresponds to the corresponding dimension, i.e., the width of the information medium 2. In this connection, the information medium 2 is securely held by the positioning stops 17*a*, 17*b* during vertical movement, as FIG. 5 shows. As FIG. 4 shows, in the depicted embodiment, the maximum dimension of the lifting medium 15 is perpendicular to the conveying direction, i.e., its width is greater than the distance between the two conveyor belts 14*a*, 14*b* that run parallel to one another. This has the advantage—as described above—that the lifting plate 15 with its upward-projecting positioning stops 17*a*, 17*b* can securely guide an information medium 2, and the information medium 2 cannot slip perpendicular to the conveying direction.

So that, when the lifting plate 15 is raised, the latter is not obstructed by the conveyor belts 14*a*, 14*b*, the conveyor belts 14*a*, 14*b* are guided in a meandering manner in the area of the marking region 5. To this end, two conveyor belts 14*a*, 14*b* in each case are guided by multiple conveyor rollers 18*a*, 18*b*, which are arranged in two different planes in the area of the marking region 5. In addition to the upper conveyor rollers 18*a*, the conveyor device 9 according to FIG. 4 has in addition two lower conveyor rollers 18*b* per conveyor belts 14*a*, 14*b*. In this case, the lifting plate 15 is arranged in its first, lower position above the lower conveyor rollers 18*b* and below the upper edge of the upper conveyor rollers 18*a*, whereby the individual positioning stops 17*a*, 17*b* in each case are positioned between two upper conveyor rollers 18*a*. Between two positioning stops 17*a*, 17*b* made on one side of the lifting plate 15, the lifting plate 15 in each case has a recess 19*a*, 19*b*, which forms a free space for an upper conveyor roller 18*a*.

By the conveyor belts 14*a*, 14*b* that are thus guided in a meandering manner, the lifting plate 15 can be raised easily into its second, upper position according to FIG. 6, in which an information medium 2 is brought to rest from below against the insert 11 of the receiving device 6. In this marking position, the individual marking signs of the information medium 2 can now be marked by the marking laser 4.

From FIG. 3, moreover, it can be seen that the inserts 11, 11', 11" in each case have on their top an identifying field 20, in which information in the form of a barcode is applied on the information media 2 that are to be marked. The information can be read using an optical acquisition element 21, namely a barcode laser—shown in FIG. 2. Using the barcode laser 21, the information contained in the barcode can be read in before the marking process via the information medium 2, in particular via its material, and based on this information, the corresponding parameters for the marking laser 4 are automatically set.

FIG. 2 shows that in the marking region 5, there are arranged in each case four grippers 22 that are opposite one another in pairs, which, as the receiving device 6 enters the marking region 5, automatically attach and grip an information medium 2, resting on the support surface 13 of an insert 11', in the form of a carrier sheet. Since, in general, gases that arise during marking with a marking laser are suctioned off with a suctioning device, grippers 22 prevent an information medium 2 from moving during the marking process because of the suctioning-off of gases.

Figure 7A:
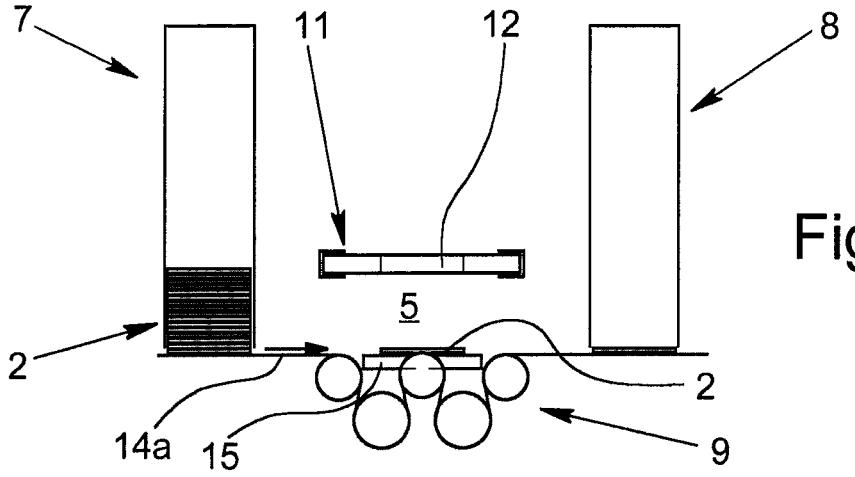
FIGS. 7*a*-7*c* show three successive diagrammatic views of the process of conveying an information medium in the automatic operation of the marking device.
Figure 7B:
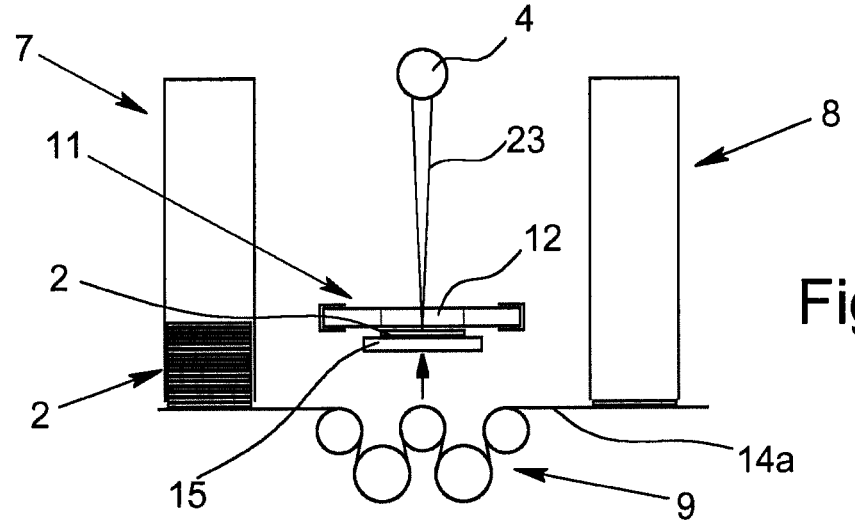
Figure 7C:
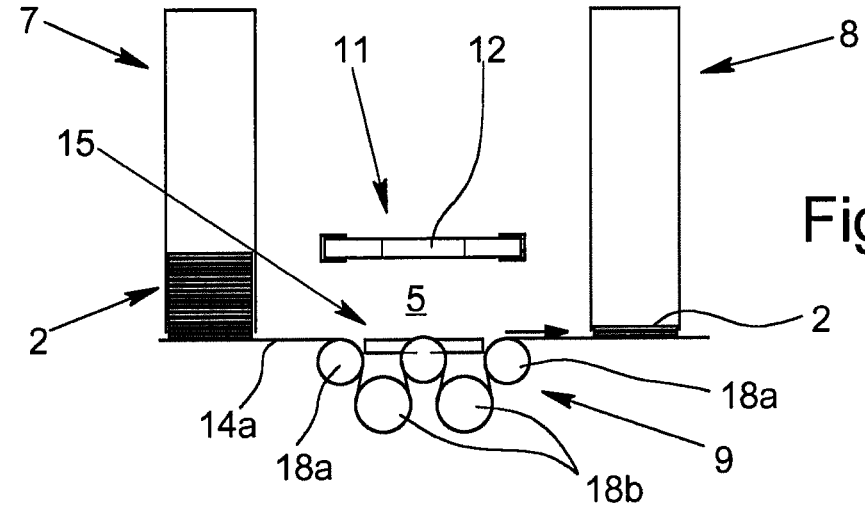

In conclusion, the conveying process of an information medium 2 during automatic operation of the marking device 1 according to the invention is to be explained again based on the three depictions in FIGS. 7*a*-7*c*. In the first step, an information medium 2 that is to be marked is conveyed from the feed magazine 7 that is designed as a destacking magazine by means of the conveying device 9 into the first, lower level in the marking region 5 (FIG. 7*a*). In this position, the lifting plate 15 of the positioning device is located in its first, lower position below the information medium 2, which rests on the conveyor belts 14*a*, 14*b*.

In the second step, the information medium 2 is raised into its marking position; to do this, the lifting plate 15 runs into its second, upper position, in which it is arranged above the conveyor belts 14*a*, 14*b*. In this case, the information medium 2 comes to rest from below on the insert 11 of the receiving device 6 in such a way that the information medium 2 can be marked with the marking laser 4 through the opening 12 in the insert 11. In this case, the information medium 2 is located in its marking position, in which the top of the information medium 2 is arranged in the focal plane of the laser beam 23 of a marking laser that is used as a marking unit 4 (FIG. 7*b*).

After completion of the marking process, the lifting plate 15 is run back into its first, lower position, by which the information medium 2 is laid down again on the conveyor belts 14*a*, 14*b*. The information medium 2 can then be conveyed using the conveyor device 9 from the marking region 5 laterally—toward the right in the depicted embodiment—to the deposit magazine 8 that is designed as a stacking magazine, as is depicted in FIG. 7*c*.

Then, in the above-described way, the next information medium 2 can be conveyed from the feed magazine 7 in two steps into the deposit magazine 8, whereby the information medium 2 in the area of the marking region 5 is raised from the lifting plate 15 into the marking position, marked by the marking laser 4 there, and then run back into the first, lower position by the lifting plate 15. Thus, multiple information media 2 arranged in the feed magazine 7 are automatically marked in succession, without in each case an individual information medium 2 having to be inserted by a user into the receiving device 6, so that multiple information media 2 can also be marked quickly and easily.

The invention claimed is:

1. Marking device for marking information media, comprising:

a housing, a marking unit, a marking region inside the housing, a receiving device for receiving at least one information medium, the receiving device being movable horizontally between a loading and unloading position outside of the marking region and a marking position inside the marking region, a feed magazine for receiving a plurality of information media that are to be marked, a deposit magazine for depositing a plurality of marked information media, a conveyor device for moving individual information media in succession from the feed magazine into a first, lower level in the marking region in an automatic mode of operation, and a positioning device for vertically raising the individual information media from the first, lower level into a second, upper level in the marking region, and after marking, and for lowering the individual information media back into the lower level and then into the deposit magazine, in said automatic mode of operation, wherein the receiving device is constructed and arranged to enable manual insertion of an information medium into the receiving device by a user in a manual mode of operation, and wherein the marking device is selectively switchable between the manual mode of operation and the automatic mode of operation.

2. Marking device according to claim 1, wherein the receiving device has a frame and a removable insert.

3. Marking device according to claim 2, wherein the insert has an opening that is sized and shaped in a manner that enables an information medium to lie flat against the insert from below in the marking position and to be marked through the opening.

4. Marking device according to claim 2, wherein the insert has a support surface on which an information medium is positionable.

5. Marking device according to claim 2, wherein the insert has an identifying field in which information about the information medium that is to be marked is applied, and wherein an optical detecting element for detecting the information is arranged inside the marking region.

6. Marking device according to claim 1, wherein the conveyor device has two conveyor belts that run parallel to one another and on which an information medium rests when the information medium is moved from the feed magazine in the marking region and from the marking region to the deposit magazine.

7. Marking device according to claim 6, wherein the positioning device has a lifting plate that is movable between a first, lower position and a second, upper position, whereby an information medium resting on the lifting plate is located in the second, upper position for marking, and wherein the second, upper position of the lifting plate is located above the conveyor belts.

8. Marking device according to claim 7, wherein the lifting plate has upward-projecting positioning stops between which an information medium is positionable, and wherein the positioning stops are disposed opposite one another at a distance from one another that corresponds to corresponding dimensions of the information medium.

9. Marking device according to claim 8, wherein a plurality of conveyor rollers are assigned to each of the two conveyor belts, wherein the conveyor rollers are arranged on two different levels in the area of the marking region so that the conveyor belts are guided in a meandering manner by the conveyor roller in the area of the marking region, wherein the lifting plate is arranged in the first, lower position above lower ones of the conveyor rollers and below an upper edge of upper ones of said conveyor rollers, and wherein the individual positioning stop are each arranged between two of the upper ones of the conveyor rollers.

10. Marking device according to claim 1 wherein at least two fixing elements that are opposite to one another are arranged in the marking region in such a way that the position of an information medium that is arranged in the marking position in the marking region is secured by the fixing elements.

11. Marking device according to claim 1, wherein a marking laser is provided as a marking unit and wherein a top side of an information medium is arranged in a focusing plane of the laser beam of the marking laser in the marking position.

* * * * *